United States Patent [19]

Moldovan et al.

[11] Patent Number: 4,672,350

[45] Date of Patent: Jun. 9, 1987

[54] VIBRATION AND SHOCKPROOF OVERLOAD PROTECTION SUBASSEMBLY FOR AN ELECTRIC DEVICE

[75] Inventors: Peter K. Moldovan, Cascade; Michael R. Larsen, Milwaukee, both of Wis.

[73] Assignee: Eaton Corporation, Cleveland, Ohio

[21] Appl. No.: 912,860

[22] Filed: Sep. 29, 1986

[51] Int. Cl.[4] ..... H01H 71/16

[52] U.S. Cl. ..... 337/82; 337/70; 335/45

[58] Field of Search ..... 337/82, 75, 70, 74; 335/45, 43

[56] References Cited

U.S. PATENT DOCUMENTS 3,944,959 3/1976 Kidd ..... 337/82

4,486,733 12/1984 Moldovan et al. ..... 337/101

*Primary Examiner*—Harold Broome

*Attorney, Agent, or Firm*—D. A. Rowe; L. G. Vande Zande

[57] ABSTRACT

A bimetal operated latch subassembly (600) for an electrical device such as an overload/switch device which is a self-contained unit that can be mounted into operative position relative to the trippable member (012) of the electrical device. A bimetal assembly (660) and a pair of terminals (604,621) electrically connected thereto are mounted on a main insulating base (601). A vibration and shockproof latch assembly (610) is preassembled on a stainless steel sub-base (611) which is then secured by a single screw (605) to the main base (601) at the same time coupling the bimetal assembly (660) to the latch (610) in operative relationship. The latch (610) is rendered shockproof by providing a spring-biased linear slider (650) that latches to a transversely pivoted latch lever (613). The latch friction that must be overcome by the bimetal (608) is reduced to a minimum by providing the latch lever (613) with an adjustable bias (614,615) that almost balances the tripping force (Y) of the trippable member (012). Calibration for a desired trip curve is attained by providing a screw (664) adjustment of the linkage (661,662) between the bimetal assembly (660) and the spring-biased linear slider (650) thereby to set the tension force on the bimetal (608) at ambient room temperature whereby it will meet the hot and cold ambient temperature trip requirements also without the use of an ambient temperature compensating bimetal or the like.

11 Claims, 5 Drawing Figures

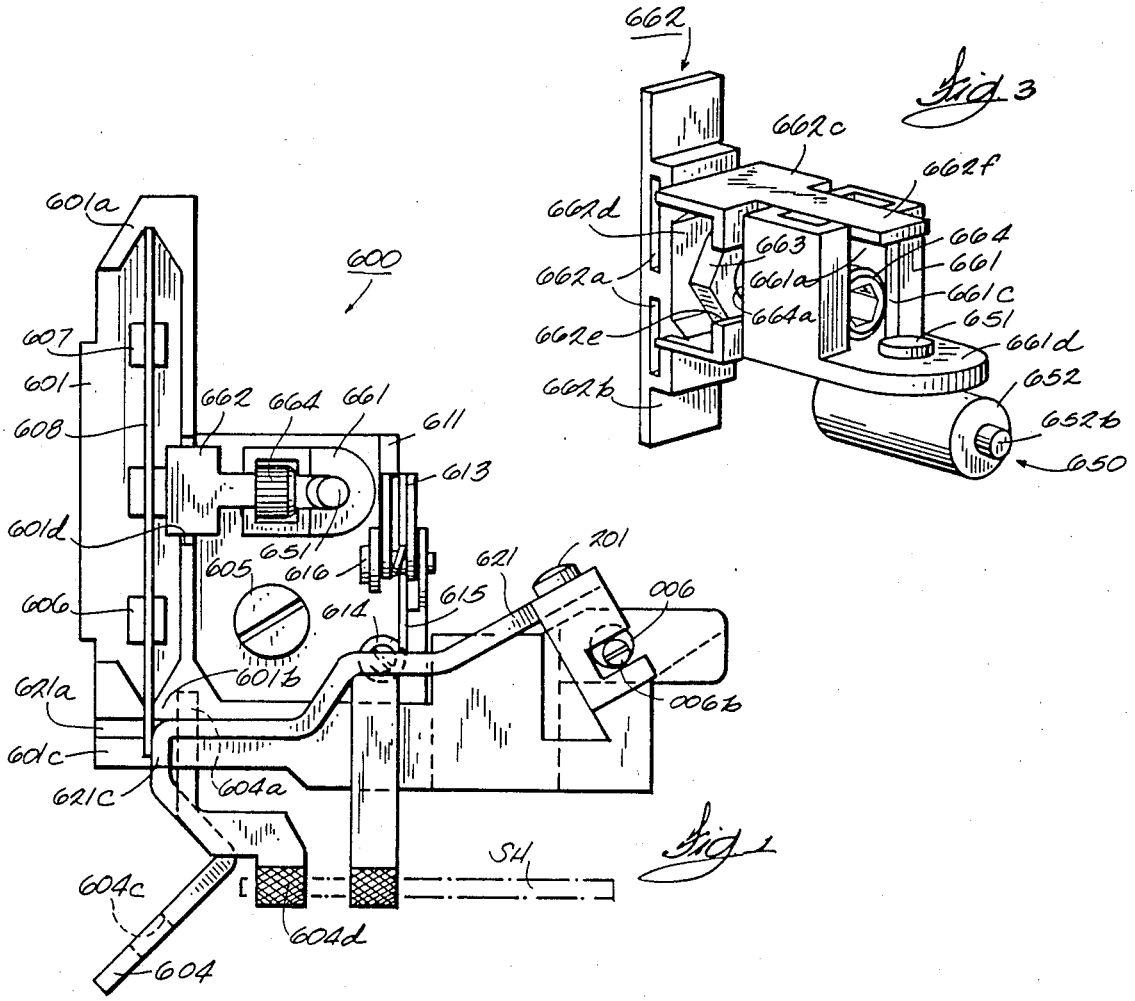
Fig 3
Fig 1
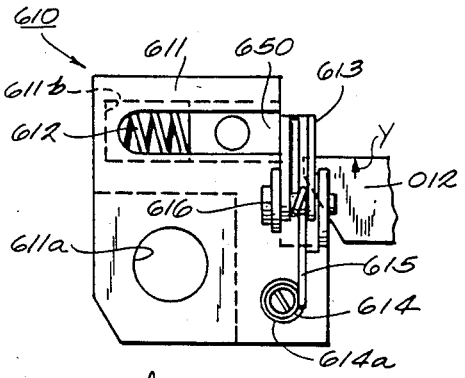
Fig 4
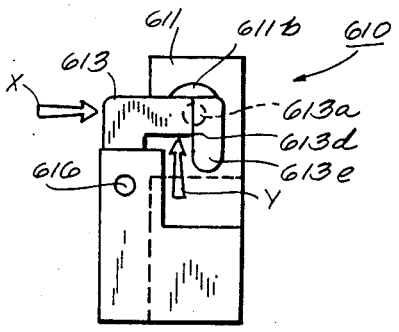
Fig 5

VIBRATION AND SHOCKPROOF OVERLOAD PROTECTION SUBASSEMBLY FOR AN ELECTRIC DEVICE

BACKGROUND OF THE INVENTION

Overload protection means of the electrothermal type have been known heretofore. For example, U.S. Pat. No. 4,486,733, P. K. Moldovan et al, dated Dec. 4, 1984, shows an electrothermal responsive protective mechanism of the bimetal type having also an ambient temperature compensating bimetal element to maintain accurate operation of the protective mechanism despite ambient temperature changes. In the mechanism shown in that patent, the overload tripping force is provided by the relatively cooler ambient temperature compensating bimetal element rather than by the hot electrically heated bimetal element to prevent overstress of the latter. It will be apparent that the thermal mechanism shown in that patent is not a self contained unit or subassembly but instead all of the components thereof must be individually assembled into the housing of the electrical device such as a circuit breaker/switch with which it is used. While thermal mechanisms of the type shown in that patent have been useful for their intended purposes, it has been found desirable to provide improvements thereover while at the same time retaining the good features thereof.

SUMMARY OF THE INVENTION

An object of the invention is to provide an improved overload protection subassembly as a self contained unit which can be preassembled and then mounted as a unit in the electrical device such as a circuit breaker/switch, for example, with which it is used.

A more specific object of the invention is to provide an improved vibration and shockproof overload protection subassembly of the aforementioned type.

Another specific object of the invention is to provide an electrothermal protection subassembly of the aforementioned type that can be given any one of a plurality of different overload ratings by connecting a selected amperage shunt thereon.

Another specific object of the invention is to provide an electrothermal protection subassembly of the aforementioned type that is constructed so that it fails safe if the electrically heated bimetal fuses or takes a permanent set.

Another specific object of the invention is to provide an electrothermal protection subassembly of the aforementioned type that can be readily calibrated for a desired overload trip curve without the use of any ambient temperature compensating bimetal.

Another specific object of the invention is to provide an electrothermal protection subassembly of the aforementioned type with improved means to prevent overstress of the hot electrically heated bimetal element.

Another specific object of the invention is to provide a vibration and shockproof electrothermal protection subassembly of the aforementioned type that has provision for balancing the latch bias forces so as to reduce to a desired minimum the work that has to be done by the hot bimetal.

Another specific object of the invention is to provide an electrothermal protection subassembly of the aforementioned type with improved means for rendering it immune to shock and vibration conditions.

Another specific object of the invention is to provide an electrothermal protection subassembly of the aforementioned type with an improved latch trip mechanism which when adjusted at room ambient temperature will meet the hot and cold ambient trip curves also without the use of any ambient temperature compensating bimetal.

Another specific object of the invention is to provide a vibration and shockproof electrothermal protection subassembly of the aforementioned type that is of minimum size and complexity.

Other objects and advantages of the invention will hereinafter appear.

BRIEF DESCRIPTION OF THE DRAWINGS

FIG. 1 is an enlarged front elevational view of the vibration and shockproof overload protection subassembly for an electrical device constructed in accordance with the invention and showing the various parts thereof in their assembled orientation.

FIG. 3 is an isometric view of a portion of the subassembly of FIG. 1 showing the adjustable link between the bimetal and the latch.

FIG. 4 is a front elevational view of a portion of FIG. 1 including the sub-base and the latch mounted thereon and with the link removed for a clearer view of the latch along with a fragmentary view of the trippable member of the electrical device to show its orientation and engagement by the latch.

FIG. 5 is a right side view of the sub-base and latch of FIG. 4.

DESCRIPTION OF THE PREFERRED EMBODIMENT

Figure 2:
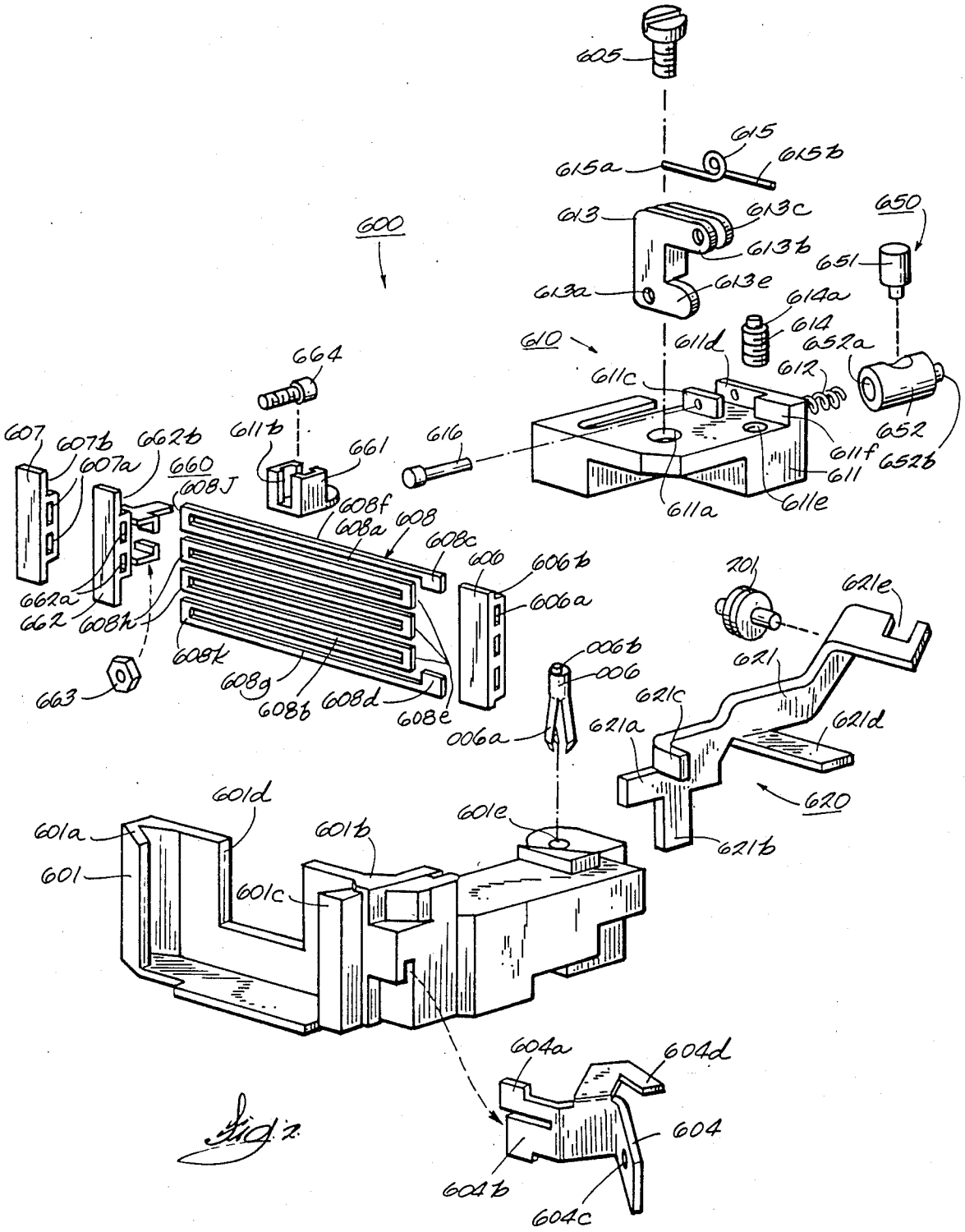
FIG. 2 is an exploded isometric view of the subassembly enlarged, less than FIG. 1 showing the various parts thereof separated from the other parts.

Referring to FIG. 1, there is shown a vibration and shockproof overload protection subassembly for an electrical device constructed in accordance with the invention. As shown in FIG. 1 and also in the exploded isometric view in FIG. 2, this subassembly 600 is provided with an insulating molded plastic main base 601 and a subbase 611 which is attached by a screw 605 to the main base. This main base 601 is provided with a V-shaped acute angle vertical wall 601*a* for supporting one end of a bimetal element 608 and with a pair of walls 601*b* and 601*c* spaced therefrom providing a slit therebetween for supporting the other end of bimetal element 608 as shown in FIG. 1 while allowing movement thereof when the bimetal element bends.

Bimetal assembly 660 as shown in FIG. 2 includes not only the aforementioned bimetal element 608 but also a pair of spacers 606 and 607 and a latch guide 662. As most clearly shown in FIG. 2, bimetal element 608 comprises a rectangular plate of bimetal material provided with alternate slits 608*a* and 608*b* extending horizontally from the right and left ends thereof and terminating short of the left and right ends thereof, respectively, and progressing from the top edge to the bottom edge of such plate so as to form a continuous flat ribbon from one enlarged-area terminal 608*c* at its upper right corner to a second enlarged-area terminal 608*d* at its lower right corner which terminals are at opposite ends of the continuous flat ribbon thus to provide a greatly extended strip having a higher efficiency and occupying a relatively small space, this bimetal shape being generally similar to that shown in assignee's P. K. Moldovan et al U.S. Pat. No. 4,486,733.

Spacers 606 and 607 are molded of electrically insulating thermoset material or the like and are provided for supporting the turned back loops at the opposite end portions of the bimetal ribbon. As shown in FIG. 2, spacer 606 is provided with three narrow slots 606*a* therethrough for receiving the three bimetal loops 608*e* at the right-hand end of the bimetal element and is also provided with notches 606*b* at its opposite ends for supporting the upper and lower horizontal strips 608*f* and 608*g* of the bimetal element. Spacer 607 is provided with two narrow slots 607*a* therethrough for receiving the two central bimetal loops 608*h* at the left-hand end of the bimetal element and is also provided with longer notches 607*b* at its opposite ends for supporting the upper and lower bimetal loops 608*j* and 608*k* at the left-hand end of the bimetal element.

Latch guide 662 made of similar thermoset material has a portion similar to spacer 607 in that it has two narrow slots 662*a* therethrough for receiving the two center loops at the left-hand end of the bimetal element and also has a pair of longer notches 662*b* at its upper and lower ends for receiving upper and lower loops 608*j* and 608*k* of the bimetal element. As will be apparent from FIG. 2, latch guide 662 is slipped onto bimetal element 608 from the left side thereof approximately to its center point and then spacer 606 is slipped onto the bimetal element from the right-hand end thereof and spacer 607 is slipped onto the bimetal element from the left-hand end thereof for supporting the opposite end portions of the bimetal element and to keep the fingers or loops thereof separated so they don't short out electrically.

Latch guide 662 also has integrally molded therewith means for supporting link adjusting means 663, 664 as more clearly shown in FIG. 3. This link adjusting supporting means includes a projection 662*c* having a nut receiving pocket 662*d* opening thereinto from one side and a screw shank receiving slot 662*e* in the forward wall of such projection opening also from the same side so that the nut 663 and the threaded shank 664*a* of a screw 664 may be inserted thereinto with nut 663 being nonrotatably held between the upper and lower walls of pocket 662*d*. As shown in FIG. 3, projection 662*c* of latch guide 662 is also provided with an integrally molded forwardly extending strip of tongue 662*f* for forwardly sliding engagement with a latch clip 661 having a pocket 661*a* within which the head of adjusting screw 664 is confined for free rotation. As shown in FIG. 3, pocket 661*a* opens into latch clip 661 from the top and the rear wall of latch clip 661 also has a vertical slot 661*b* most clearly shown in FIG. 2 opening from the top and wide enough for receiving the shank of adjusting screw 664. The forward wall of pocket 661*a* in latch clip 661 is also provided with a similar narrow slot 661*c* opening down from the top to provide access for the end of a hexagonal wrench for turning screw 664. As shown in FIGS. 2 and 3, screw 664 is preferably a slotted head machine screw threaded into a hexagonal nut 663 and having a hexagonal slot in the head thereof for receiving the end of a hexagonal rod known as an Allen wrench. Latch clip 661 is also provided with a flat portion or tab 661*d* extending forwardly from its lower portion and having a vertical round hole therethrough for receiving pin 651 of latch slider assembly 650 as shown in FIG. 3. As also shown in FIGS. 2 and 3, the space between the opposite edges of slots 661*b* and 661*c* at the upper portions thereof is just wide enough to slidingly receive guiding extension or tongue 662*f* of latch guide 662. Latch clip 661 has a flat bottom which slides along the flat upper surface of sub-base 611 both when screw 664 is adjusted and also when the bimetal bends under overload conditions. Base 601 is provided with an opening 601*d* in its wall 601*b* as shown in FIG. 2 through which latch guide 662 freely extends.

As shown in FIGS. 4 and 5, the latch is assembled onto sub-base 611 and then this sub-base assembly or latch assembly 610 is attached to main base 601 by a screw 605 as shown in FIG. 1, this screw 605 being also shown at the upper portion of FIG. 2. Sub-base 611 is provided with a hole 611*a* shown in FIG. 4 through which screw 605 extends and threads into a hole in main base 601. This sub-base 611 which is also known as the slider housing is preferably made of metal such as stainless steel and is provided with a race in the form of a cylindrical hole 611*b* which is closed at its rear or left end and open at its front or right end as shown in FIG. 4 for accommodating slider assembly 650 and its helical compression spring 612. As shown in FIG. 4, compression spring 612 is in the bottom of cylindrical hole 611*b* and biases slider 650 outwardly through the open end of this hole. As shown in FIG. 2, slider 650 has a generally cylindrical body portion or piston 652 and a perpendicular pin 651 rigidly secured thereto as by riveting or the like into a hole countersunk at both ends and this pin extending upwardly from substantially the center portion thereof. Both piston 652 and pin 651 are preferably made of metal such as stainless steel or the like. The rear end of cylindrical piston 652 is provided with a shallow recess 652*a* for receiving the forward end of compression spring 612. The forward end of piston 652 is provided with an integrally formed reduced diameter and slightly flared latch pin 652*b* shown in FIG. 3 which enters a blind hole 613*a* shown in dotted lines in FIG. 5 in the adjacent side of latch lever 613 to engage the latch, this latch pin 652*b* and blind hole 613*a* being also shown in FIG. 2.

For pivoting the latch lever 613 on sub-base 611, sub-base 611 is provided with a pair of spaced apart upstanding walls 611*c* and 611*d* having aligned holes therethrough for receiving a pivot pin 616 and latch lever 613 is provided with spaced apart lateral extensions 613*b* and 613*c* positioned between walls 611*c* and 611*d* and having aligned holes therethrough through which pivot pin 616 also extends with pivot pin 616 being riveted or flared on the outside of sub-base wall 611*d* as shown in FIG. 4.

Pivot pin 616 also extends through a single turn torsion spring 615 that is positioned between spaced extension 613*b* and 613*c* of latch lever 613. A first end 615*a* of torsion bias spring 615 extends into the channel between spaced extension 613*b* and 613*c* of the latch lever and presses down thereon to apply a clockwise bias onto latch lever 613 as represented by arrow X in FIG. 5. The other end 615*b* of torsion spring 615 overlies the annular edge 614*a* of an adjusting screw 614 that is threaded into a hole 611*e* in sub-base 611. Wall 611*d* of sub-base 611 is provided with a thicker portion 611*f* immediately adjacent screw 614 to prevent this end 615*b* of the torsion spring from slipping off the annular edge of the screw. This screw 614 may be turned to adjust the bias of spring 615 onto latch lever 613. It will be apparent that if screw 614 is turned in, the spring bias is reduced and if screw 614 is turned out the spring bias is increased. The manner of setting this spring bias will become apparent as the description proceeds.

FIG. 4 also shows a fragmentary portion of the trippable member 012 of the electrical device with which this overload protection subassembly is used. This trippable member 012 is spring-biased in its tripping direction represented by arrow Y in FIGS. 4 and 5. It will therefore be apparent that as viewed in FIG. 5, the spring of the trippable member applies a force onto latch lever 613 in the counterclockwise direction as indicated by arrow Y whereas bias spring 615 applies a force onto latch lever 613 in the clockwise direction as indicated by arrow X. The purpose of bias spring 615 and its bias adjustment by screw 614 is to balance these forces X and Y as nearly as is practical to reduce the friction force of the latch 652*b*, 613*a* and thus to minimize the friction force that the hot bimetal must work against. As a practical matter, the spring force Y of trippable member 012 must be greater than the bias force applied by torsion spring 615 so that when the latch is disengaged by the bimetal, trippable member 012 will be able to push latch lever 613 counterclockwise out of the way thereby to allow the electrical device to trip. Trippable member 012 is provided with a flat front surface so that as it pushes latch lever 613 counterclockwise out of the way, corner 613*d* of latch lever 613 shown in FIG. 5 will ride on the front surface of trippable member 012 and will never fall behind it which otherwise might prevent resetting of the latch. The lower portion of trip lever 613 is provided with a lateral tab 613*e* adjacent latch hole 613*a* along which latch pin 652*b* will slide when the latch is released and which will guide latch pin 652*b* back into engagement in blind hole 613*a* when the latch is reset thus to prevent the latch pin from ever falling behind the latch lever and rendering resetting inoperative.

This overload protection subassembly 600 is also provided with a pair of terminals 604 and 620 connected to the opposite ends of bimetal 608. For this purpose, terminal 604 is provided with a pair of slightly offset arms including an upper arm 604*a* having a lug whereby this terminal is trapped in a slot in base 601 and a lower arm 604*b* which is soldered to terminal 608*d* at the lower lefthand corner of bimetal 608. Terminal 604 is also provided with a hole 604*c* for receiving a terminal screw or the like for connecting the terminal to an electrical circuit. Terminal 604 is furthermore provided with an outwardly extending tab 604*d* providing connection to a shunt SH as hereinafter more fully described in connection with terminal assembly 620 and shown in broken lines in FIG. 1.

This overload protective subassembly 600 is also provided with a second terminal assembly 620 shown in FIG. 2 having a contact 201 mounted thereon and providing connection from the other end of the bimetal 608 to the electrical device such as a circuit breaker/switch with which this overload protection subassembly is used. Terminal assembly 620 is also provided with a terminal 621 onto which contact 201 is mounted as by riveting or the like. Terminal 621 is provided with lateral and downward projections 621*a* and 621*b* whereby it is seated in suitable slots in main base 601. Terminal 621 is also provided with an outwardly bent tab 621*c* which is soldered to terminal 608*c* at the upper righthand corner of bimetal 608 as shown in FIG. 1. Terminal 621 is further provided with an outwardly extending tab 621*d* to afford soldering a resistor shunt SH from this tab 621*d* to tab 604*d* of the other terminal so that the shunt will be in parallel with bimetal element 608 and a shunt of a selected resistance value will give the overload protection subassembly the desired rating. Terminal 621 is furthermore provided with a slot 621*e* at its terminal end which overlies an adjusting member 006 frictionally mounted in a hole 601*e* in base 601. As shown in FIG. 2, adjusting member 006 is provided with a plurality of flared spring legs 006*a* for frictionally retaining the same in the hole in the base. The upper end of adjusting member 006 is provided with an eccentric smaller diameter reduced portion 006*b* having a screwdriver slot therein to facilitate turning the same and thereby moving contact 201 to adjust its spacing relationship with the opposite contact (not shown) in the electrical device with which this subassembly is used.

From the foregoing it will be apparent that latch lever bias adjusting screw 614 may be adjusted to almost balance the spring bias force of trippable member 012 thereby to reduce to a minimum the friction-overcoming work that must be performed by the hot bimetal under overload conditions. Also link adjusting or calibrating screw 664 may be adjusted to calibrate this device to a desired overload trip curve. It has been found that if screw 664 is adjusted under ambient room temperature conditions such as plus 25° C., this overload protection subassembly will also meet the trip curve requirements under cold and hot ambient temperature conditions, such as minus 55° C. and plus 71° C., and it will do this without the necessity of including any ambient temperature compensating bimetal elements or the like. And this overload protection subassembly is constructed so as to be vibration and shockproof such that it will not have a tendency to trip under vibration and shock conditions. This is for the reason that slider assembly 650 is spring-biased and moves in a linear direction whereas trip lever 613 is pivoted and spring-biased and moves in a plane transverse to such linear direction. As a result of this, shock and vibration forces regardless of the direction from which they are applied do not cause inadvertent tripping. Moreover, this construction fails safe if the bimetal element takes a permanent set because it will remain tripped.

While the apparatus hereinbefore described is effectively adapted to fulfill the objects stated, it is to be understood that the invention is not intended to be confined to the particular preferred embodiment of vibration and shockproof overload protection subassembly for an electrical device disclosed, inasmuch as it is susceptible of various modifications without departing from the scope of the appended claims.

We claim:

1. A vibration and shockproof overload protection subassembly for an electrical device having a spring-biased trippable member restrained by said subassembly and being operative when released thereby for performing an overload protective function with respect to said electrical device comprising;

an insulating base;

an overload current responsive means mounted on said base;

a pair of electrical terminals mounted on said base and connected to said overload current responsive means for conducting current therethrough to said electrical device;

a spring-biased tripping member mounted for reciprocal movement in a first direction;

a spring-biased trip lever mounted for movement in a plane transverse to said first direction and normally restraining said trippable member;

coupling means between said tripping member and said trip lever engageable by the force of said spring bias of said tripping member and said coupling means being releasable by said overload current responsive means to free said spring-biased trippable member;

and an adjustable link means between said overload current responsive means and said spring-biased tripping member for selectively adjusting the amount of engagement of said coupling means under the force of said spring bias of said tripping member thereby to calibrate said device for a desired overload current tripping characteristic.

2. The vibration and shockproof overload protection subassembly claimed in claim 1, wherein:

said overload current responsive means comprises a bimetal element.

3. The vibration and shockproof overload protection subassembly claimed in claim 2, wherein:

said bimetal element comprises an elongated flat strip that reverses in direction from left to right and from right to left a number of times in a common plane and having enlarged area terminals at its upper right and lower right ends connected to said pair of electrical terminals.

4. The vibration and shockproof overload protection subassembly claimed in claim 1, wherein said spring-biased tripping member mounted for reciprocal movement in a first direction comprises:

a hollow race in said base having a closed end and an open end and an elongated slot along its top;

a freely movable slider guided in and reciprocally movable in said race;

a pin extending from said slider through said elongated slot in said base coupling said slider to said adjustable link means;

and a compression spring in said closed end of said race biasing said slider so as to extend partly out said open end whereat it is restrained by said adjustable link means.

5. The vibration and shockproof overload protection subassembly claimed in claim 4, wherein said coupling means between said tripping member and said trip lever comprises:

a projection and a blind hole with one thereof being on the external end of said slider and the other thereof being on the adjacent side of said trip lever for normally coupling said trip lever against movement and said trip lever being releasable upon retraction of said slider by said overload current responsive means to free said spring-biased trippable member for tripping.

6. The vibration and shockproof overload protection subassembly claimed in claim 1, wherein said adjustable link means comprises:

a first link segment attached to said overload current responsive means;

a second link segment coupled to said spring-biased tripping member;

interfitting means on said frist and second segments guiding them for linear direction of movement with respect to one another;

and connecting means between said first and second segments and being operable to adjust the length of said link means in said linear direction thereby to adjust the tension between said spring-biased tripping member and said overload current responsive means.

7. The vibration and shockproof overload protection subassembly claimed in claim 1, wherein said connecting means comprises:

a headed screw having a threaded shank and a nut threaded on said shank;

a slot in one of said link segments for receiving said nut and the adjacent portion of said shank and for nonrotatably retaining said nut;

and a slot in the other of said link segments for receiving the head and adjacent portion of said shank and for providing access for a tool to turn said screw.

8. The vibration and shockproof overload protection subassembly claimed in claim 7, wherein said headed screw comprises:

a slotted head on said screw for receiving the end of a hexagonal wrench for adjusting said screw thereby to adjust the length of said link means.

9. The vibration and shockproof overload protection subassembly claimed in claim 1, wherein said spring-biased trip lever comprises:

a trip lever pivotally mounted on said base;

and a balancing spring applying a force to said trip lever partially opposing the spring bias of said trippable member thereby to reduce the friction of said coupling means.

10. The vibration and shockproof overload protection subassembly claimed in claim 9, wherein said spring-biased trip lever also comprises:

means for adjusting the force of said balancing spring to a value a predetermined amount less than the force of said spring-biased trippable member.

11. A vibration and shockproof electrothermal protection subassembly for an electrical device comprising;

an insulating base;

a bimetal element mounted in said base;

a pair of electrical terminals mounted on said base and connected to said bimetal element for conducting current therethrough to said electrical device;

a spring-biased tripping member mounted for reciprocal movement in a first direction;

a trip lever mounted for pivotal movement in a plane transverse to said first direction;

and coupling means between said tripping member and said trip lever engageable by the force of said spring bias of said tripping member and said coupling means being releasable;

a spring-biased trippable member on said electrical device restrained by said trip lever and being operative when released by said trip lever for performing a protective function;

and said subassembly also comprising an adjustable link means between said bimetal element and said tripping member for selectively adjusting the degree of tension on said bimetal element and thus the amount of engagement of said coupling means under the force of said spring bias of said tripping member thereby to calibrate said device for a desired thermal tripping characteristic.

* * * * *